US006842067B2

(12) United States Patent
Andrys et al.

(10) Patent No.: US 6,842,067 B2
(45) Date of Patent: Jan. 11, 2005

(54) INTEGRATED BIAS REFERENCE

(75) Inventors: Paul Andrys, Swisher, IA (US); David Ripley, Cedar Rapids, IA (US)

(73) Assignee: Skyworks Solutions, Inc., Irvine, CA (US)

( * ) Notice: Subject to any disclaimer, the term of this patent is extended or adjusted under 35 U.S.C. 154(b) by 0 days.

(21) Appl. No.: 10/135,490

(22) Filed: Apr. 30, 2002

(65) Prior Publication Data

US 2003/0201791 A1 Oct. 30, 2003

(51) Int. Cl.[7] ..... G05F 1/10
(52) U.S. Cl. ..... 327/539; 327/538
(58) Field of Search ..... 327/538, 539, 327/543, 540, 541; 323/312

(56) References Cited

U.S. PATENT DOCUMENTS 5,774,013 A * 6/1998 Groe ..... 327/543
5,886,570 A * 3/1999 Brokaw ..... 327/540
6,023,157 A * 2/2000 Kazuno ..... 323/312
6,466,081 B1 * 10/2002 Eker ..... 327/541

* cited by examiner

*Primary Examiner*—Dinh T. Le
(74) *Attorney, Agent, or Firm*—The Eclipse Group

(57) ABSTRACT

An improved integrated bias reference provides a temperature and supply stable bias for devices such as radio frequency amplifiers with less complexity and expense than conventional bias references. The bias reference may be integrated onto a single GaAs die with other active circuitry such as an amplifier.

18 Claims, 5 Drawing Sheets

Replacement Page

500

INTEGRATED BIAS REFERENCE

BACKGROUND OF THE INVENTION

1. Field of the Invention

This invention relates to biasing, and in particular to a bias reference for an amplifier.

2. Related Art

Amplifiers are used in an enormous array of applications. In many applications, amplifiers do not need to strictly adhere to rigorous performance criteria. In other applications, however, amplifiers are critical components and must function in accordance with precise operating specifications. Furthermore, market competition and customer specifications are a significant driving faction of key amplifier parameters. For example, a product with a more efficient amplifier can offer extended battery life, and thereby provide a competitive edge in the marketplace.

Thus, on one hand, the amplifiers are preferably designed and biased to draw as little battery current as possible so that battery life is extended. On the other hand, the amplifiers must also operate at a bias point that provides ample capability for generating a powerful signal with minimal adjacent channel interference.

Adjacent Channel Power Rejection (ACPR) is a measure of interference between adjacent channels. The ACPR is generally regarded as the power ratio in a wanted signal and unwanted distortion measured over the signal band. ACPR tends to be directly related to the non-linearity of the amplifier, which, to some degree, is related to the quiescent amplifier bias.

In the past, biasing techniques required a regulated voltage input for biasing the amplifier. However, the regulated voltage input, even though regulated, still was susceptible to significant temperature variation. The temperature variation caused fluctuation in the amplifier bias and thus allowed significant variation in ACPR. Alternatively, a bandgap referenced CMOS current source was sometimes used to maintain a temperature independent bias without the need for a reference voltage.

Unfortunately, substantial cost, complexity, package size constraints, and manufacturing disadvantages accompanied creation of a separate CMOS die for the current source. For example, when the amplifier itself was fabricated on a GaAs substrate, the CMOS die had to be separately designed and manufactured, allocated room in the same package with the GaAs die, and subjected to a manufacturing process with bond wires or other connections between the CMOS die and the GaAs die.

A need has long existed for an improved amplifier bias reference that addresses the problems noted above and others previously experienced.

SUMMARY

An improved integrated bias reference is arrived at by implementing a constant voltage reference circuit in conjunction with a current conveyor circuit that drives a bias reference output. The constant voltage reference circuit and current conveyor circuit may be fabricated on a single Gallium Arsenide (GaAs) die, despite the general unavailability of PNP transistors. The integrated bias reference may be broadly conceptualized as a bias reference that provides a temperature, supply, and process stable current source for devices such as radio frequency amplifiers with less complexity and expense than conventional bias references.

For example, one implementation of the bias reference includes a GaAs substrate and a constant voltage reference circuit fabricated on the substrate. The constant voltage reference circuit implements a proportional-to-absolute-temperature (PTAT) current source summed with a $V_{be}$ current source and sourced across a resistance connected to a supply voltage in order to provide a bandgap voltage source. The bandgap voltage source provides a substantially constant voltage output referenced to the supply voltage. In addition, a current conveyor circuit is fabricated on the substrate and coupled to the constant voltage output. The current conveyor circuit includes an input stage formed with a differential amplifier and an output stage that includes a supply transistor driving a reference transistor. A bias reference output is coupled to the base of the reference transistor.

Other implementations, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE FIGURES

The components in the figures are not necessarily to scale, emphasis instead being placed upon illustrating the principals of the invention. Moreover, in the figures, like reference numerals designate corresponding parts throughout the different views.

DETAILED DESCRIPTION OF THE PREFERRED EMBODIMENTS

Figure 1:
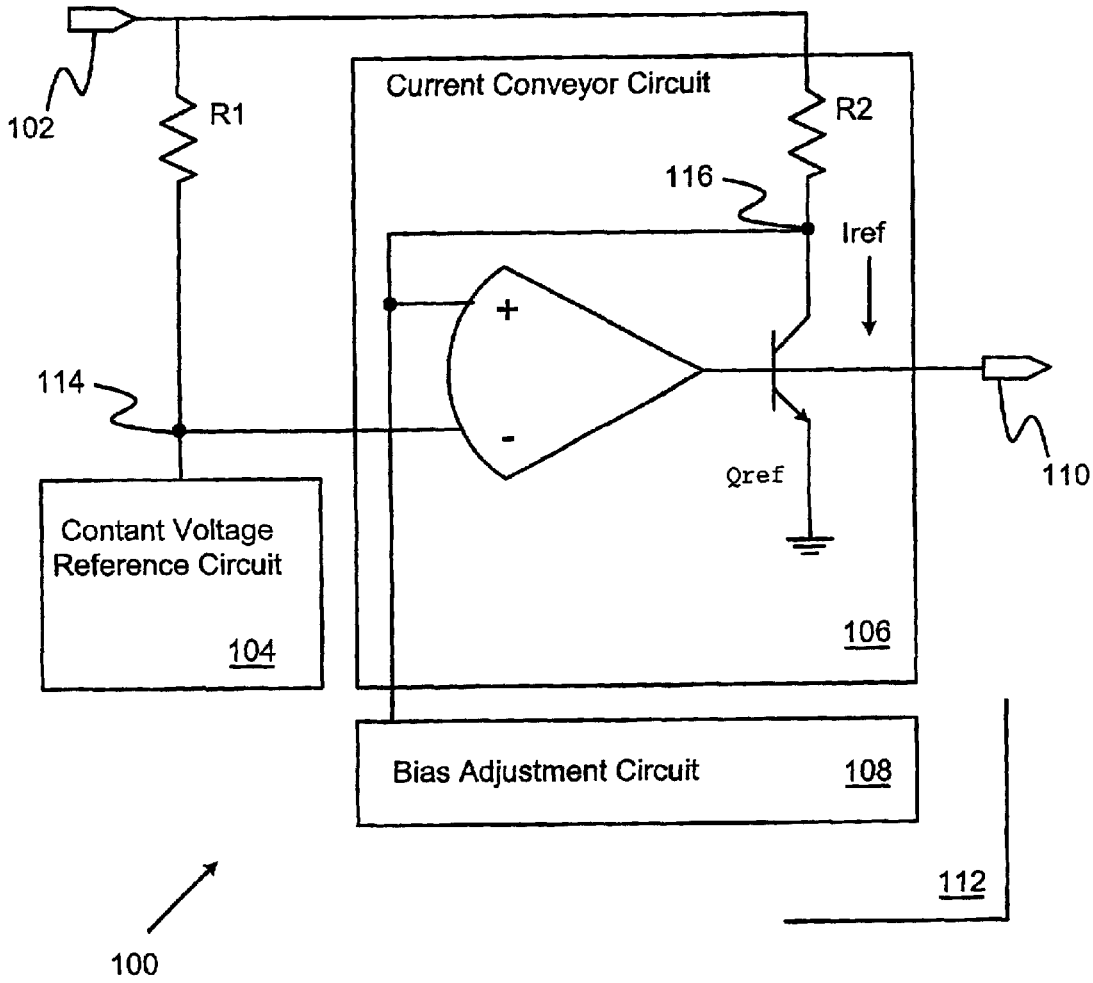
FIG. 1 shows a block diagram of a bias reference.

With regard first to FIG. 1, that figure illustrates a block diagram of a bias reference 100. The bias reference 100 includes an enable supply voltage input 102, a constant voltage reference circuit 104, and a current conveyor circuit 106. Also shown in FIG. 1 is a bias adjustment circuit 108 and a bias reference output 110. In one embodiment, the constant voltage reference circuit 104, current conveyor circuit 106, and bias adjustment circuit 108 are integrated together on a Gallium Arsenide (GaAs) substrate 112 to form the bias reference 100.

The bias reference 100 is described in detail below with reference to FIGS. 2–4. First, however, an overview of the operation of the bias reference 100 is presented.

The enable supply voltage input 102 provides a power supply for certain portions of the constant voltage reference circuit 104 and the current conveyor circuit 106. Because the power requirements for those portions are relatively small, the enable supply voltage input 102 may be connected to a digital logic output of a microcontroller or logic gate (e.g., a 3V, 5–10 mA output). The microcontroller or logic gate may then turn the bias reference 100 on or off by applying or removing the 3V logic signal from the enable supply voltage input 102.

The constant voltage reference circuit 104 provides a constant voltage output 114. The constant voltage output 114 remains relatively flat over a wide range of temperature, supply voltage, and manufacturing processes (i.e., it is temperature, supply, and process independent). As will be described in more detail below in FIG. 2, the constant voltage reference circuit 104 functions as a bandgap reference cell that incorporates a proportional-to-absolute temperature (PTAT) current source summed with a $V_{be}$ current source to maintain a constant voltage drop across R1.

The current conveyor 106 replicates the voltage present on the constant voltage output 114 at the voltage node 116. A reference current Iref is thereby established. As will be described in more detail below, the current conveyor uses a reference transistor and a supply transistor to help maintain the replicated voltage, and to supply large amounts of current from a power supply voltage input to the bias reference output 110. The current $I_{ref}$ is derived from the voltage initially generated by the constant voltage reference circuit 104. As a result, $I_{ref}$ is temperature and supply independent. Thus, the bias reference 100 helps minimize variations in the amplifier ACPR, although in general the bias reference 100 may be used with any circuit that would benefit from a stable bias.

The bias adjustment circuit 108 selectively reduces the reference current flowing through the collector of Qref. As a result, the voltage on the bias reference output 110 falls. Thus, the bias adjusting circuit 108 provides a mechanism for adjusting the amount of current supplied to a current mirror device to the bias reference output 110.

Figure 2:
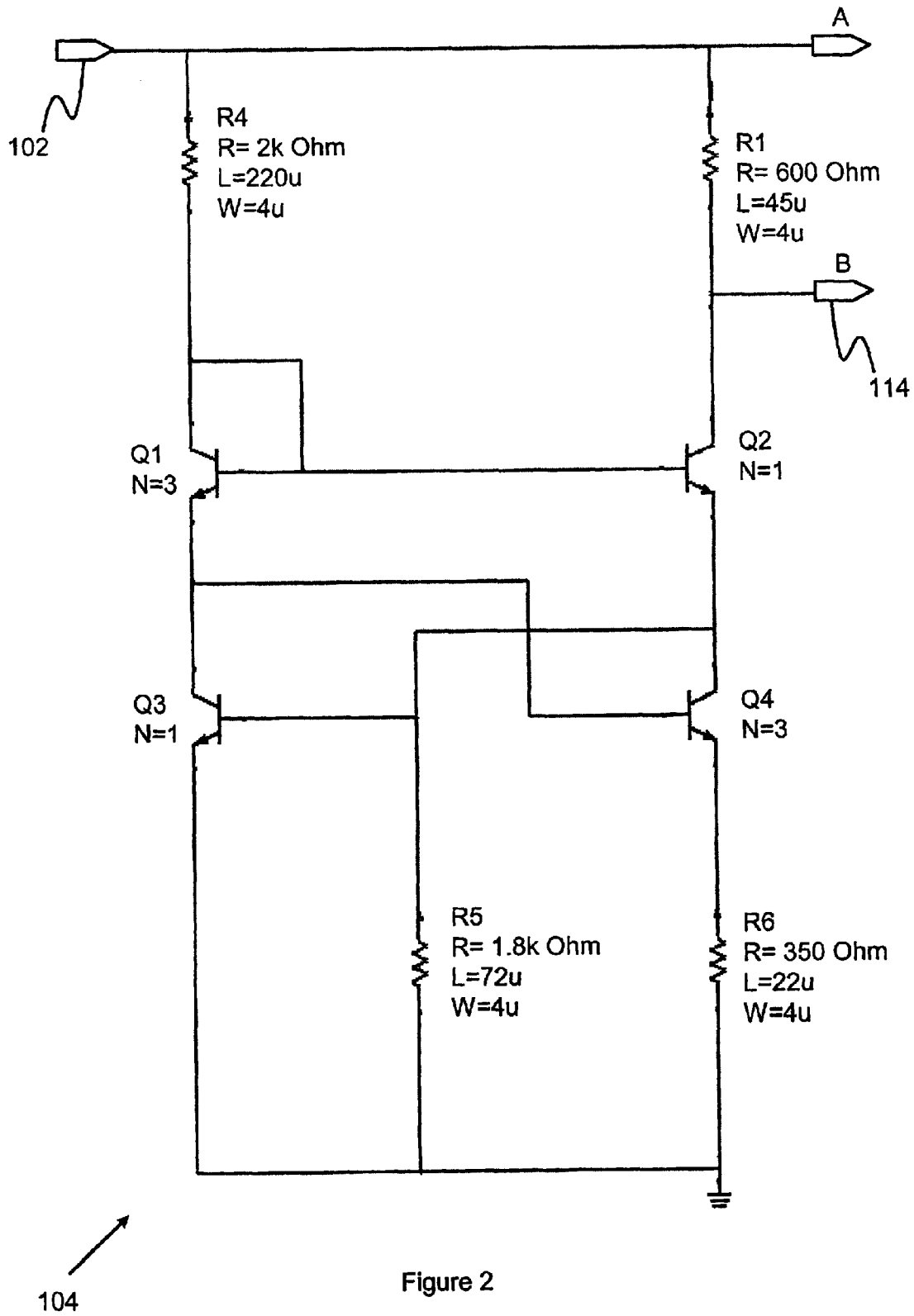
FIG. 2 shows a circuit diagram of a constant voltage reference circuit.

Turning next to FIG. 2, a circuit diagram shows one implementation of the constant voltage reference circuit 104. The transistors Q1, Q2, Q3, and Q4, in conjunction with the resistors R4 and R6, form a proportional-to-absolute-temperature (PTAT) current source. Note that there are three identical Q1 transistors and three identical Q4 transistors connected in parallel, while there is one Q2 transistor and one Q3 transistor. The interconnection of Q1–Q4, as shown, results in a temperature dependent delta Vbe voltage drop across R6, thereby establishing a PTAT current through Q4.

In particular, the PTAT current=Vt/R6*In((A1*A4)/(A2*A3)), where A1, A2, A3, and A4 are the effective areas of Q1, Q2, Q3, and Q4 respectively (e.g., 3, 1, 1, and 3), and Vt=KT/Q, were K is Boltzman's constant, T is the temperature, and Q is the electron charge. The PTAT current is thus a positive temperature coefficient current. In other words, the PTAT current increases with temperature.

The PTAT current is compensated using the resistor R5. The current through R5 (Q3 Vbe/R5) is a negative temperature coefficient current that exhibits approximately the opposite temperature variation as the PTAT current. Thus, adding the current through R5 to the PTAT current produces a current through Q2 and R1 that is independent of temperature and supply, exhibiting only the process variation of the resistors R5 and R6.

The resulting voltage drop across R1 is independent of temperature, supply, and process since the variation of R1 cancels the variation of R5 and R6 due to matching. In other words, the constant voltage reference circuit 104 provides a bandgap voltage reference, referenced to the enable supply voltage. The bandgap voltage reference is provided to subsequent circuitry on the constant voltage output 114.

Figure 3:
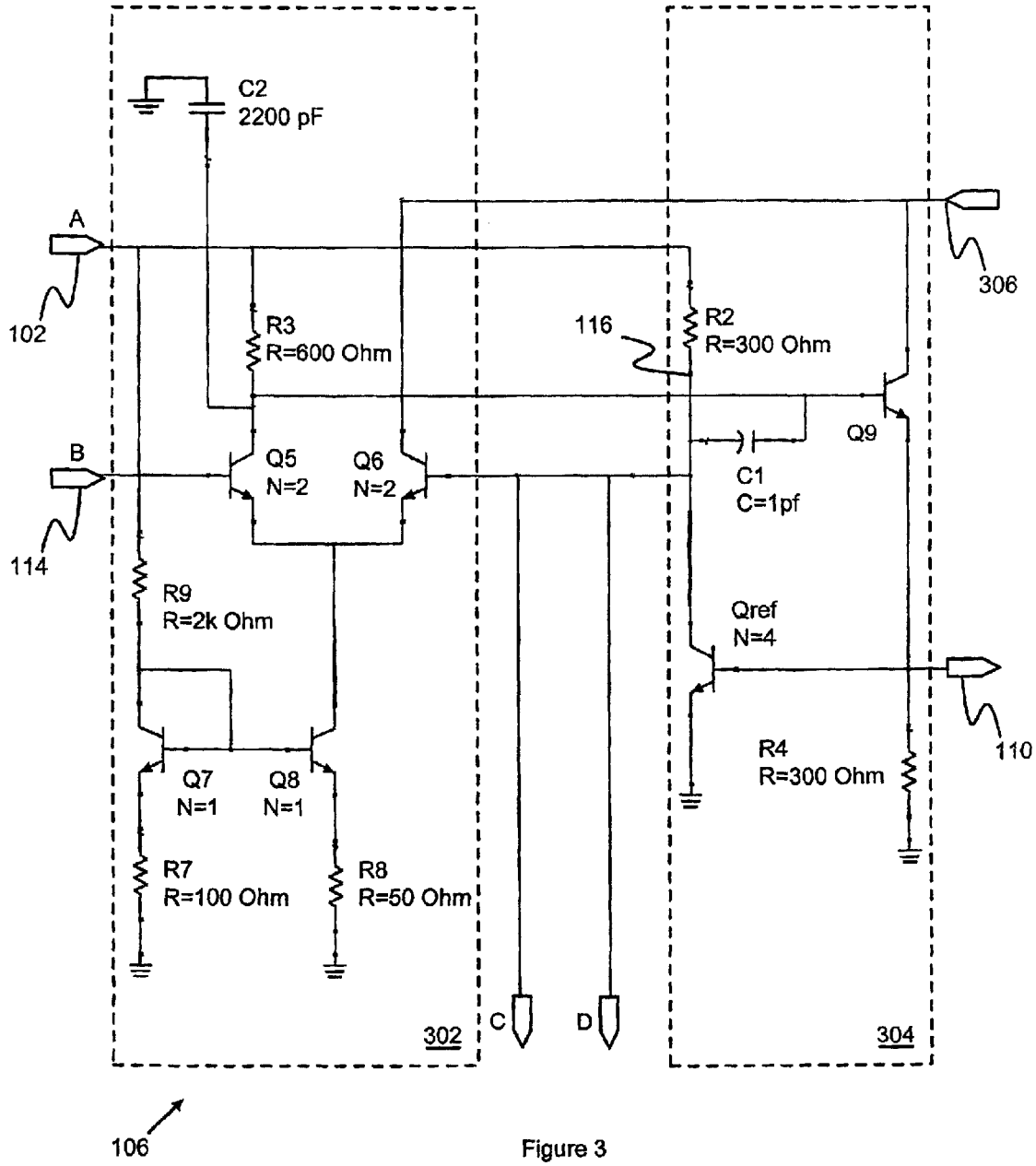
FIG. 3 shows a circuit diagram of a current conveyor circuit.

Turning to FIG. 3, the constant voltage output 114 is coupled to the current conveyor 106. In particular, the current conveyor 106 includes an input stage designated 302 and an output stage designated 304. The input stage 302 is implemented as a differential amplifier. The differential amplifier is formed using Q5, Q6, R3, and a supporting current bias. The current bias, in this implementation, is formed from Q7, Q8, R7, R8, and R9.

The input stage 302 drives the output stage 304. The output stage 304 includes the supply transistor Q9 and the reference transistor Qref. The supply transistor Q9 is connected as an emitter follower to the base of the reference transistor Qref. Qref is connected to the load resistor R2.

The input stage 302 and output stage 304 work in concert to replicate the constant voltage present on the constant voltage output 114 at the voltage node 116. In other words, the input stage 302 and output stage 304 adjust the base voltage of Qref such that the current flowing through R2 results in a voltage equal to the voltage sensed across R1. Since the voltages are held equal, the current through Qref is a temperature and supply independent current. Qref will exhibit the process variation of R2. R2 may also be external to the GaAs die providing a very tight tolerance resistive value. R2 may then be adjusted Iref, the reference current flowing into the collector of Qref.

In general, a wide variety of choices may be appropriate for R1 and R2 depending on the particular implementation for the bias reference 100. For example, the current through R1 should allow adequate voltage to bias up Q5 based on the enable supply voltage. Thus, using a 3V enable supply voltage, and 2 mA of current through R1, R1 may be 600 Ohms, thereby leaving the emitter of Q5 approximately 600 mV above ground.

The ratio of R1 to R2 may then be set according to the amount of current desired in the amplifier connected to the bias reference output 110. Note that the supply transistor Q9 biases Qref's base as well as the amplifier connected to the bias reference output 110. The amplifier input stage typically includes multiple input transistors that when connected to Qref, act like a large current mirror with Qref.

Note that in the embodiment shown in FIG. 3, four instances of Qref are connected in parallel. Thus, an amplifier with 100 input transistors draws 25 times the current flowing through Qref. Continuing the example above, when the ratio of R1 to R2 is 1, then 2 mA flows through Qref, and 50 mA flows in the amplifier. As another example, when the ratio of R1 to R2 is 2, then 4 mA flows through Qref, and 100 mA flows into the amplifier.

Note that a power supply voltage input 306 provides the current for the bias reference output 110 (through the supply transistor Q9). Because the current on the bias reference output 110 is often considerable, the power supply voltage input 306 is typically independent of the enable supply voltage input 102. For example, the power supply voltage input 306 may be connected to a high capacity battery (e.g., a cell phone battery).

Under DC operation, the current through Q9 is a constant current. However, when the amplifier is driven with a radio frequency signal, the current through Q9 into the amplifier is significantly different than the DC operating point. The choice for R3 is a function of the worst case current expected into the base of Q9. The voltage summation of the Qref Vbe+Q9 Vbe+the drop across R3 should not be greater than the enable voltage on the enable supply voltage input 102. The selection of R4 is driven by small signal stability considerations of the current conveyor 106, as R4 sets the minimum impedance load on the emitter of Q9. Adding R4 improves phase margin for low output powers when the current into the amplifier is very small.

The capacitor C1 (approximately 1 pF) and the capacitor C2 (approximately 2200 pF) in conjunction provide a dominant pole that ensures greater than 60 degrees of phase margin for the current conveyor 104 differential amplifier. The capacitor C2 may be added to the bias reference 100 at an external connection point (e.g., on a connection pin external to the GaAs die).

Figure 4:
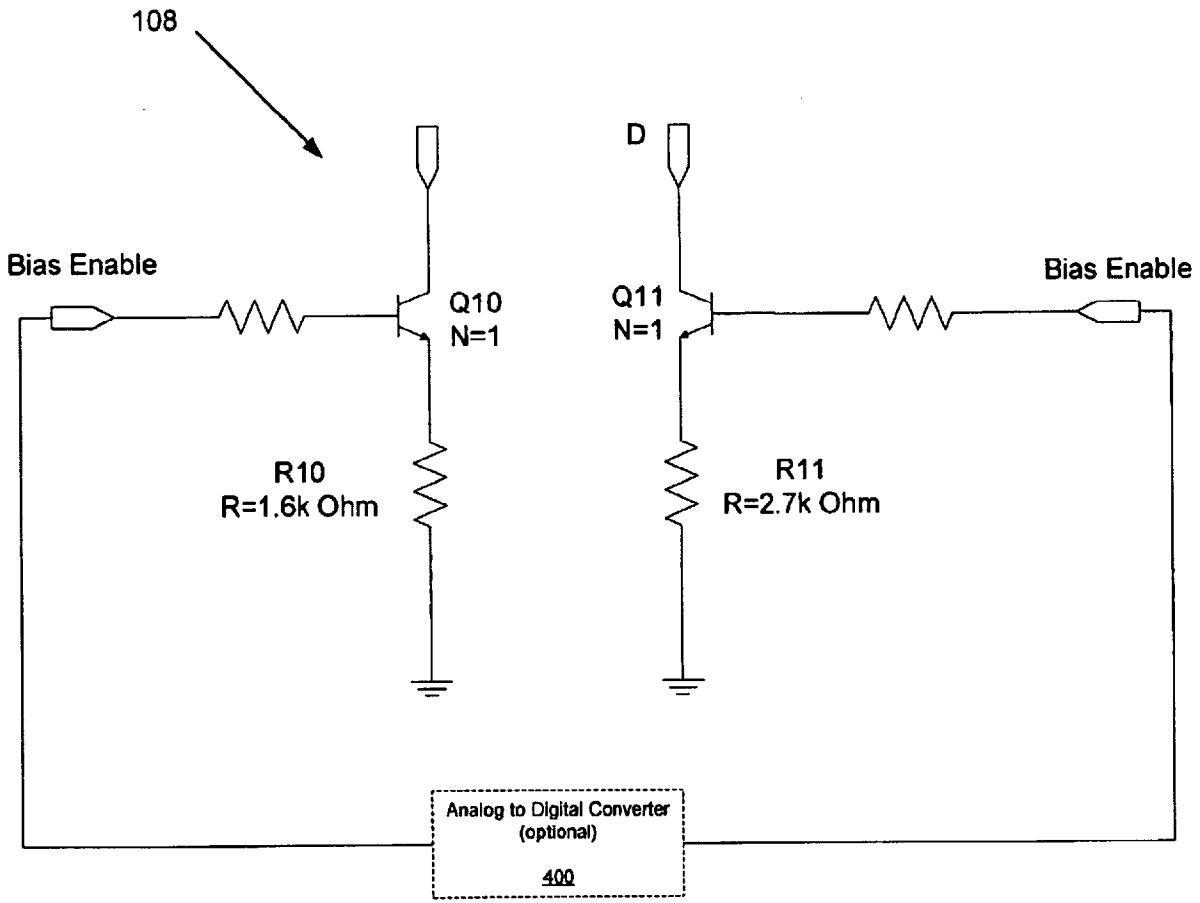
FIG. 4 shows a circuit diagram of a bias adjustment circuit.

An example of two bias adjustment circuits 108 is shown in FIG. 4. Each bias adjustment circuit is configured as a current sink formed from a transistor and resistor to ground (e.g., Q10 and R10; Q11 and R11). The base of each transistor is coupled through a resistance to a bias enable input, and the collector of each transistor is coupled to the collector of Qref. When the bias enable input carries a voltage that puts its transistor into conduction, each bias adjustment circuit pulls current away from the collector of Qref, thereby reducing the reference current into Qref, and the current mirrored to the amplifier.

The bias adjustment circuits 108 may be enabled independently, for example, by microcontroller or logic digital outputs, or by analog outputs provided by a digital to analog converter 400. Furthermore, any number of bias adjustment circuits may be included. Thus, the bias reference 100 may thereby provide a wide range of control of the Qref reference current.

Figure 5:
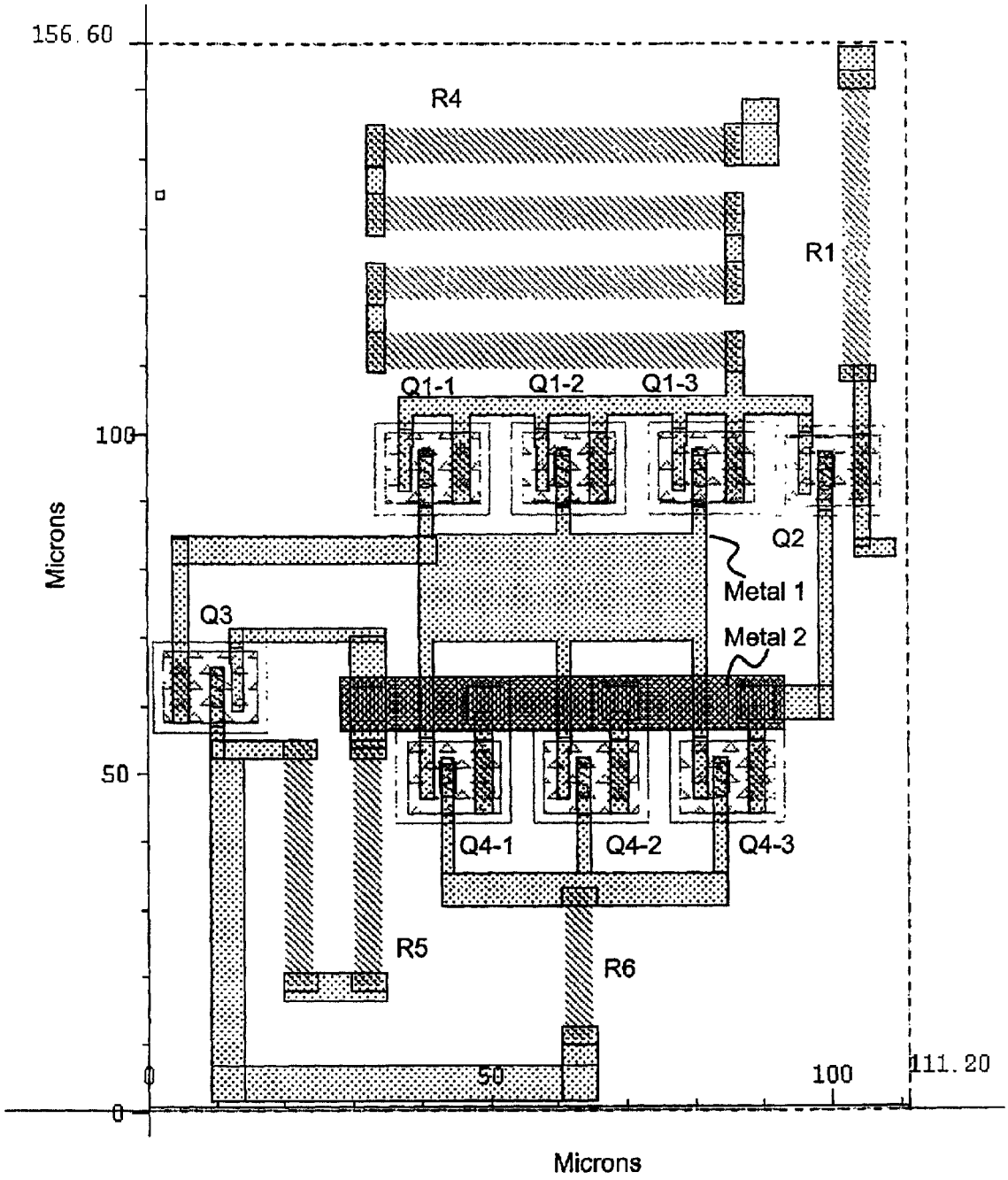
FIG. 5 shows a layout for the constant voltage reference circuit.

With regard next to FIG. 5, that figure illustrates an exemplary layout 500 for the devices shown in FIG. 2. The layout 500 shows the size and positioning of the three instances of Q1 and Q4, as well as the single instances of Q2 and Q3. Exemplary layouts for the resistors R1, R4, R5, and R6 are also shown.

Note that the bias reference 100 is completely free of PNP transistors. As a result, the bias reference 100 may be integrated onto a GaAs die (that generally does not support PNP transistors). Thus, no separate CMOS die is required for a stable voltage source, and the bias reference 100 does not incur any of the cost, complexity, or manufacturing disadvantages of prior bias references.

While various embodiments of the application have been described, it will be apparent to those of ordinary skill in the art that many more embodiments and implementations are possible that are within the scope of this invention. Accordingly, the invention is not to be restricted except in light of the attached claims and their equivalents.

What is claimed is:

1. A bias reference comprising:

an enable supply voltage input;

a constant voltage reference circuit coupled to the enable supply voltage input, the constant voltage reference circuit comprising a proportional-to-absolute-temperature (PTAT) current source summed with a Vbe current source and a constant voltage output referenced to the enable supply voltage input;

a current conveyor circuit coupled to the constant voltage output, the current conveyor circuit comprising an input stage comprising a differential amplifier and an output stage comprising a supply transistor driving a reference transistor; and a bias reference output coupled to the current conveyor circuit.

2. The bias reference of claim 1, wherein the constant voltage reference circuit and the current conveyor circuit comprise NPN transistors but no PNP transistors.

3. The bias reference of claim 1, further comprising a bias adjustment circuit coupled to the current conveyor circuit.

4. The bias reference of claim 3, wherein the bias adjustment circuit comprises a transistor coupled to a digital to analog converter.

5. The bias reference of claim 1, wherein the bias reference output couples to a base connection of an amplifier.

6. The bias reference of claim 1, wherein the supply transistor is an emitter follower transistor with a collector connected to a power supply voltage input.

7. The bias reference of claim 1, wherein the enable supply voltage is a digital logic input.

8. An integrated bias reference comprising:

a GaAs substrate;

a constant voltage reference circuit fabricated on the substrate and comprising a proportional-to-absolute-temperature (PTAT) current source summed with a Vbe current source and a constant voltage output;

a current conveyor circuit fabricated on the substrate and coupled to the constant voltage output, the current conveyor circuit comprising an input stage comprising a differential amplifier and an output stage comprising a supply transistor driving a reference transistor; and a bias reference output coupled to the current conveyor circuit.

9. The integrated bias reference of claim 8, further comprising a bias adjustment circuit fabricated on the substrate and coupled to the current conveyor circuit.

10. The integrated bias reference of claim 9, wherein the bias adjustment circuit comprises a bias adjustment enable input coupled to a current sink.

11. The integrated bias reference of claim 10, wherein the bias adjustment enable input comprises a digital logic enable input.

12. The integrated bias reference of claim 10, wherein the current sink comprises a transistor coupled to the bias adjustment enable input and a resistor coupled to the transistor.

13. The integrated bias reference of claim 8, wherein the supply transistor is an emitter follower transistor with a collector connected to a power supply input for supplying power supply base current to the reference transistor and the bias reference output.

14. An integrated bias reference comprising:

a GaAs substrate;

a constant voltage reference circuit fabricated on the substrate and comprising a temperature independent voltage output;

an input stage fabricated on the substrate and coupled to the temperature independent voltage output, the input stage comprising a replicated temperature independent voltage node;

a plurality of bias adjustment circuits fabricated on the substrate and coupled to the replicated temperature independent voltage node;

a reference transistor fabricated on the substrate and coupled to the replicated temperature independent voltage node; and a bias reference output coupled to the reference transistor.

15. The integrated bias reference of claim 14, wherein each bias adjustment circuit includes a bias adjustment enable input.

16. The integrated bias reference of claim 15, wherein the constant voltage reference circuit is coupled to an enable supply voltage input.

17. The integrated bias reference of claim 15, wherein the temperature independent voltage output is referenced to the enable supply voltage input.

18. The integrated bias reference of claim 14, further comprising a supply transistor fabricated on the substrate and coupled to the reference transistor and to a supply voltage input.

* * * * *